United States Patent [19]

LeCompte

[11] Patent Number: 4,953,803

[45] Date of Patent: Sep. 4, 1990

[54] FILAMENT WINDING APPARATUS

[75] Inventor: George W. LeCompte, Tucson, Ariz.

[73] Assignee: Hughes Aircraft Company, Los Angeles, Calif.

[21] Appl. No.: 316,614

[22] Filed: Feb. 28, 1989

[51] Int. Cl.[5] ..... B65H 54/02

[52] U.S. Cl. ..... 242/47

[58] Field of Search ..... 242/47, 53, 18 R, 1, 242/25 R, 47.01, 47.12, 84.2 R, 211, 224, 225; 57/71

[56] References Cited

U.S. PATENT DOCUMENTS

| | | | |
|---|---|---|---|
| 3,545,192 | 12/1970 | Hickman | 57/71 |
| 3,944,156 | 3/1976 | Jacobsson et al. | 242/47.12 |
| 4,050,641 | 9/1977 | Henrich | 242/25 R |
| 4,092,006 | 5/1978 | Jacobsson | 242/47.01 |

*Primary Examiner*—Stanley N. Gilreath

*Attorney, Agent, or Firm*—Robert A. Hays; Randall M. Heald; W. K. Denson-Low

[57] ABSTRACT

A filament winding apparatus has a bobbin slidably, but non-rotatably, received on a tube mounted to a base. A cylindrical case has an internal circumferential groove with gear teeth which mesh with an orbiting cylindrical bail. A base mounted sun gear located within the case meshes with bail gear teeth driving it along both a circular path and about itself as an axis. A filament to be wound passes through an eyelet axially mounted to the case, through the bail and secured to the bobbin. Rotation of the sun gear winds the filament onto the bobbin while not subjecting the filament to sharp bending stresses, and during which frictional engagement is distributed over extended eyelet, bail and filament surfaces.

6 Claims, 2 Drawing Sheets

FIG.3
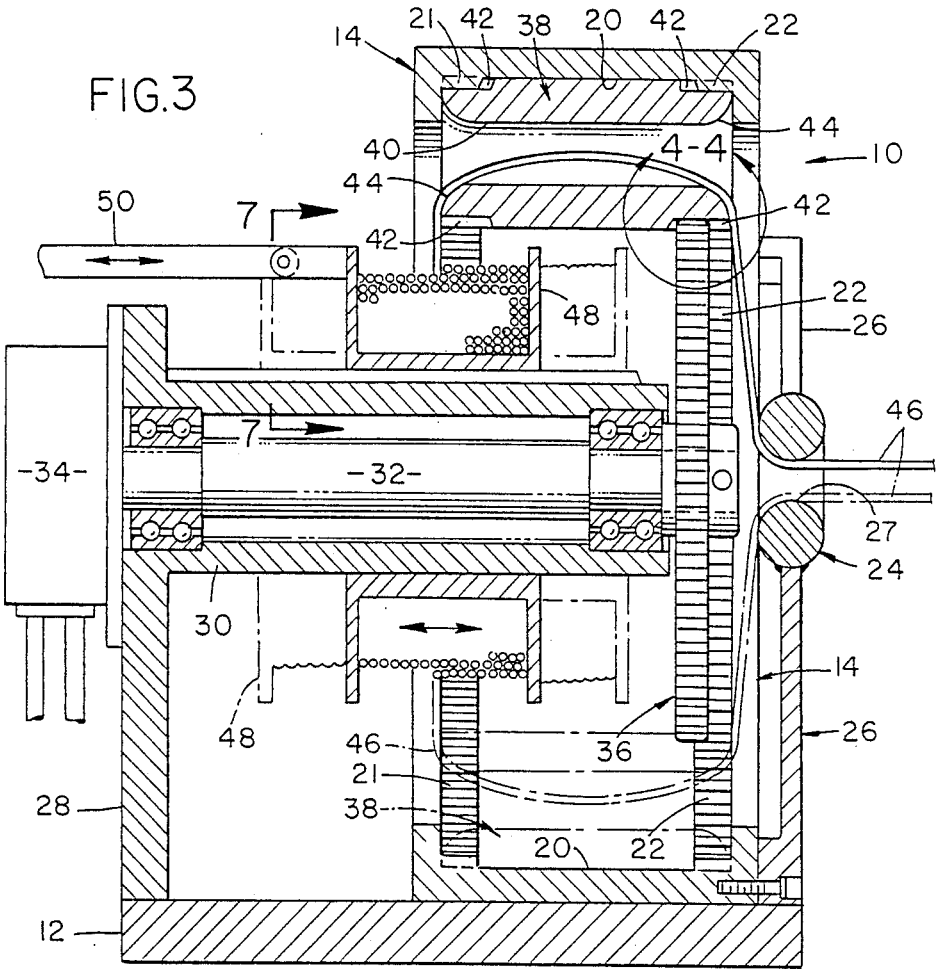
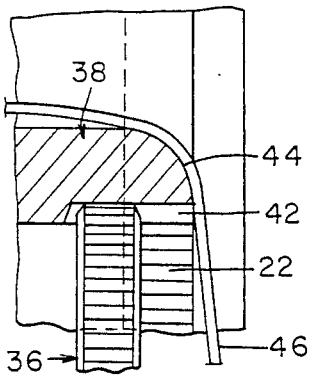
FIG.4
FIG.5
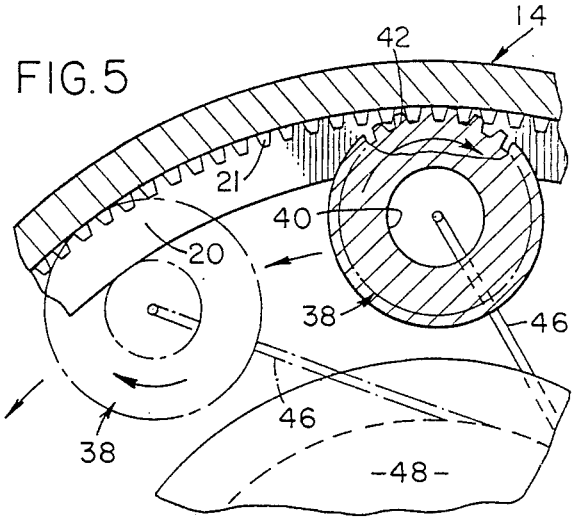

FILAMENT WINDING APPARATUS

BACKGROUND OF THE INVENTION

1. Field of the Invention

The present invention pertains to the winding of filaments such as wire or optical fibers, and more particularly to apparatus for winding such filaments rapidly and without placing undue stress and strains on the filament.

2. Description of Related Art

There are numerous circumstances in which an extended length of a filament (e.g., wire or optical fiber) is wound onto a bobbin or drum portion of a missile, for example, in order to provide a data link during use. Such filaments throughout their storage and as well as during winding must not be subjected to stresses or strains exceeding a certain amount since otherwise the transmission of data can be substantially impaired.

In addition to winding an actual filamentary data link, filament winding apparatus is used in testing facilities where the filament is payed out at missile flight speed for test purposes. For this purpose, it is also important that the filament not be stressed since this would degrade test results.

Existing drum filament payout machines have turbine-driven drums on which the filament is wound to pay it out from a dispenser at a desired speed (e.g., missile flight speed). A primary disadvantage of such machines is that the end of the filament attached to the drum is not directly available to permit transmission testing during payout. Also, centrifugal loading on the wound up fiber threatens its physical survival during test and may contribute to optical loss during payout.

It has been suggested in the past that filaments be wound onto a stationary drum in the manner of the spin-casting reel used by fishermen. Although it is not known whether or not this has actually been attempted, there would be at least two obstacles to be overcome, namely, (1) the filament would have to make three turns (out from the axis, back parallel to the axis and inward to the drum surface), since pulleys are impractical at payout speeds and friction at a fixed eyelet will produce excessive heating and wear, and, (2) the extreme centrifugal loads would present a severe structural design challenge for the cantilevered bail arm.

SUMMARY OF THE DISCLOSURE

In accordance with the present invention there is provided filament payout or winding apparatus including a stationary cylindrical outer case affixed to a base which can be conveniently located as desired. A hollow tubular member is mounted on the same base and extends with its tubular axis colinear to that of the stationary case.

A sun gear is concentrically mounted via an axle extending through the cylindrical tubular member for driving rotation. An orbiting bail having gear teeth on its outer surface meshes with the complementary gear teeth on the inner surface of the stationary case and with the sun gear teeth. Accordingly the bail moves both in a circular path about the drive shaft as center and about itself as an axis.

A non-rotating drum is releasably and concentrically located on the tubular member and serves as the bobbin on which filament is wound. Filament from a conveniently located source of supply passes through a fixed eyelet, then through an opening in the orbiting bail, and has an end affixed to the non-rotating drum.

A drive turbine causes the orbiting bail to move around the non-rotating drum and wind filament onto the drum. Means are also provided for reciprocating axial movement of the drum to produce a uniform buildup of the filament on the drum (level winding).

DESCRIPTION OF THE DRAWING

In the accompanying drawings:

FIG. 3 is a side elevational, sectional view taken along the line 3—3 of FIG. 2;

FIG. 4 is a side elevational, sectional, partially fragmentary view of the region 4–4 shown in FIG. 3;

FIG. 5 is an end elevational, sectional view showing the bail in two different winding positions;

DESCRIPTION OF A PREFERRED EMBODIMENT

Figure 1:
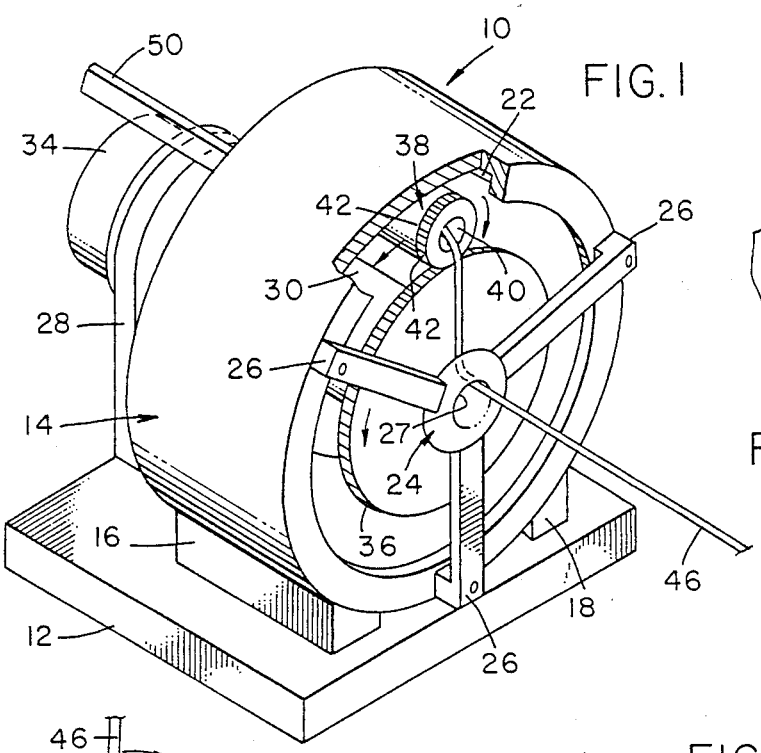
FIG. 1 is a perspective view of the winding apparatus of this invention.
Figure 7:
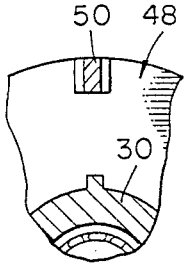
FIG. 7 is a side elevational, sectional view taken along the line 7—7 of FIG. 3.
Figure 6:
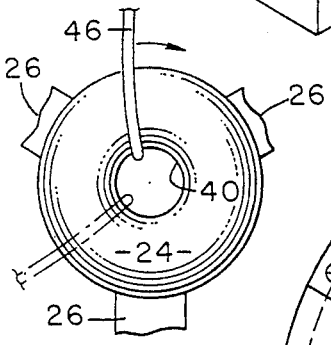
FIG. 6 is an enlarged end elevational view of the bail showing slippage of the filament during winding.
Figure 2:
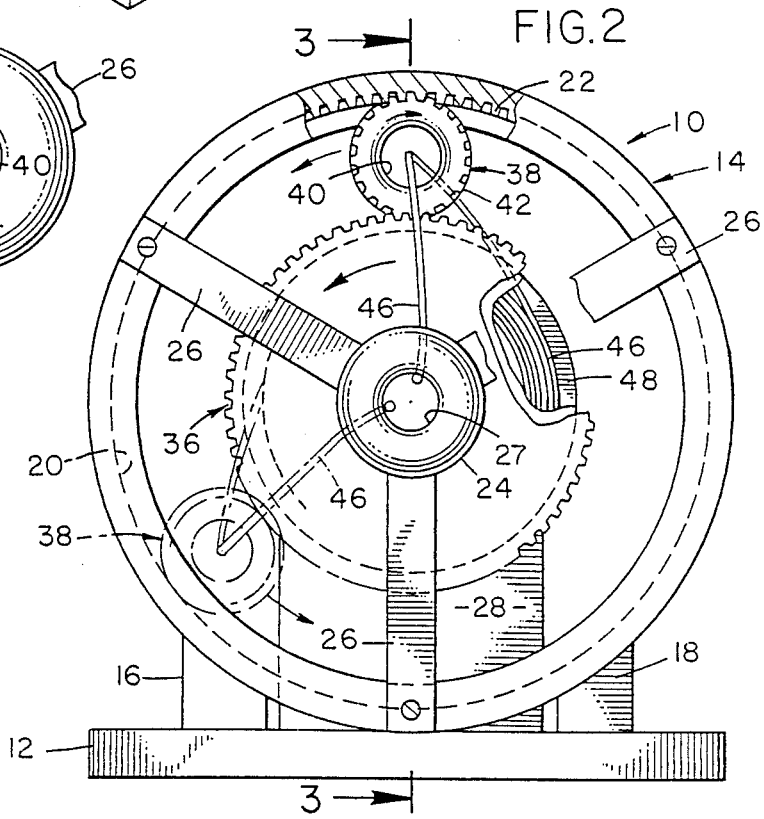
FIG. 2 is an end elevational partially sectional view of the apparatus of FIG. 1.

Turning now to the drawings and particularly FIGS. 1 and 3, the winding apparatus of the present invention is enumerated generally a 10 and is depicted mounted on a rectangular base 12. A stationary case 14, having a longitudinal axis, consisting of an open ended metal cylinder is fixedly secured to the base 12 by a pair of mounting blocks 16 and 18. A uniformly dimensioned, circumferentially extending groove 20 is formed on the case inner surface (FIG. 3) and includes two sets of gear teeth 21 and 22 for a purpose to be described.

An eyelet 24 is secured to the outer end surface of the case 14 by a plurality of arms 26 fixedly locating the eyelet at the case center and approximately in the case end plane along the axis of the case. The eyelet is essential toroidal and provides an opening 27 with curved surfaces facing both the entrance and exit ends of the case for a purpose to be elaborated on later.

A vertical upstanding wall 28 affixed to the base 12 includes a generally horizontally extending metal tube 30 which has its longitudinal axis lying along the longitudinal axis of the stationary case 14. A drive shaft 32 is journaled within the tube 30 with one end extending through an opening in the wall 28 for driving relation with a rotative power source 34 and the opposite end passing outwardly of the tube 30.

A sun gear 36 secured to the shaft outer end for rotation about an axis colinear with the axis of the case has its gear teeth generally positioned in the groove 20 and meshing with gear teeth 42 on the orbiting bail 38. The orbiting bail 38 consisting of a metal cylinder has a bore 40 extending completely therethrough and gear teeth 42 on its outer surface which mesh with those of the sun gear. Further, the cylinder of the bail 38 includes gear teeth 42 on both ends of the outer surface thereof that mesh with the set of teeth 21 at one end and the sun gear 36 and teeth 22 at the other end thereof. The cross-sectional dimensions of the bail are such that when the bail is meshed with the sun gear it simultaneously meshes with the case teeth 22. The length of the bail is such as to enable receipt within the groove 20. Still further, the internal surface of the orbiting bail is smooth and has curved exit edges 44 at both ends for filament protection, as will be shown.

In use, a filament 46 from a source of supply (not shown) is passed through the eyelet 24, across and spaced from the outer end surface of the sun gear 36, through the orbiting bail 38, and downwardly for securement to a non-rotating drum 48 (FIG. 3) mounted on tube 30 and having an axis colinear with the axis of the case. The drum serves as a bobbin and is dimensioned for axial reciprocative sliding movement along the tube 30 by a conventional power source identified schematically as 50. Rotative power is then applied to the shaft 32 which drives the sun gear, the latter motion both rotating and moving the orbiting bail along a circular path. The combination bail movement causes the filament to be removed from the source and laid down onto the bobbin with the reciprocative bobbin motion producing level windings.

Due to centrifugal loading, the filament that is located within the orbiting bail assumes a catenary-like shape (FIG. 3) and, therefore, the size and shape of the internal bore of the orbiting bail must be made so that the filament will not be forced against the opposite wall. Also, any constraints on the bend radius must be reflected in the shape of the bail openings and of the fixed entry eyelet.

Rolling of the orbiting bail inside the stationary case causes the filament to move circularly within the fixed inlet eyelet. This latter motion has the desirable beneficial effect of distributing heating and wear effects over relatively large areas. For low friction materials, for example, the increase of tension at each turn of the filament path in the described apparatus should total less than ten percent (10%) which is an acceptable penalty.

A matter of major consideration in the described bail-type winder construction is centrifugal loading, particularly where the apparatus is to be used for fiber payout testing. That is, of necessity the bail velocity must be greater than the payout speed by the ratio of the bail orbit radius to the winding radius. For example, where there is a one foot bail radius and a ten inch winding radius, payout at 1,000 feet per second results in radial acceleration of 45,000 G,s. Or, expressed slightly differently, a bail weighing one pound will produce enough lateral force to induce a vibration amplitude of 6 mils on a one ton case.

From a strength standpoint, the orbiting bail must withstand the centrifugally induced loading. Fatigue is also an important consideration, since the tube rotation frequency is several times higher than the orbital frequency of the bail. Composite materials should offer the possibility of meeting requirements for both high fatigue strength, low weight, and good lubricity.

Although the filament winding apparatus of this invention has been described in connection with a preferred embodiment, it is to be understood that modification will be apparent to those skilled in the appertaining art which will come within the spirit of the invention.

What is claimed is:

1. Apparatus for winding a filament onto a tubular bobbin; said apparatus comprising:

a cylindrical case, having a longitudinal axis, a base plate, said case having an inner wall surface formed into a continuous circumferentially extending groove having gear teeth arranged therelong;

an eyelet secured to the case with the eyelet opening lying on the axis of the cylindrical case;

a sun gear mounted within the case for rotation about an axis colinear with the axis of the cylindrical case and the gear teeth of said sun gear lying directly opposite the case groove;

means for rotating the sun gear; and a tubular bail having a set of teeth on an outer surface for meshing with the sun gear, the dimensions of the bail being such as to simultaneously mesh with the gear teeth in the case groove;

means for mounting a bobbin colinear with the axis of the case;

such that the filament passes through the eyelet and the tubular bail prior to being wound on a bobbin.

2. Apparatus as in claim 1, in which the sun gear is mounted on the end of a drive shaft journaled within a metal tube secured to the base, which metal tube comprises the means for mounting the bobbin.

3. Apparatus as in claim 1, in which the bail has smooth internal wall surfaces and radiused internal end openings.

4. Apparatus as in claim 2, in which means are provided for reciprocating the bobbin along the metal tube during winding for producing level filament windings thereon.

5. Apparatus as in claim 1, in which the eyelet is toroidal in shape presenting curved contacting surfaces to the filament during filament winding.

6. Apparatus as in claim 1, in which the eyelet is secured to an end of the cylindrical case by a plurality of arms.

* * * * *